US005730583A

United States Patent [19]

Alizadeh

[11] Patent Number: 5,730,583

[45] Date of Patent: Mar. 24, 1998

[54] AXIAL FLOW FAN BLADE STRUCTURE

[75] Inventor: Ahmad Alizadeh, Indianapolis, Ind.

[73] Assignee: Valeo Thermique Moteur, LeMesnil Saint Denis, France

[21] Appl. No.: 453,835

[22] Filed: May 31, 1995

Related U.S. Application Data

[63] Continuation-in-part of Ser. No. 314,827, Sep. 29, 1994, abandoned.

[51] Int. Cl.[6] ..... F04D 29/38

[52] U.S. Cl. ..... 416/189; 416/169 A; 416/238

[58] Field of Search ..... 416/169 A, 189 R, 416/238, 243

[56] References Cited

U.S. PATENT DOCUMENTS

| | | | |
|---|---|---|---|
| 1,800,313 | 4/1931 | Melcher et al. | 416/243 |
| 4,334,824 | 6/1982 | Tsuchikawa et al. | 416/238 |
| 4,505,641 | 3/1985 | Tsuchikawa et al. | 416/189 |
| 4,548,548 | 10/1985 | Gray, III | 416/189 R |
| 4,685,513 | 8/1987 | Longhouse et al. | 416/238 |
| 4,971,520 | 11/1990 | Van Houten | 416/169 A |
| 5,193,981 | 3/1993 | Scheidel et al. | 416/169 A |
| 5,393,199 | 2/1995 | Alizadeh | 416/189 |
| 5,399,070 | 3/1995 | Alizadeh | 416/189 |

FOREIGN PATENT DOCUMENTS

| | | | |
|---|---|---|---|
| 0904464 | 11/1945 | France | 416/189 |
| 0228072 | 1/1925 | United Kingdom | 416/189 |
| 0139028 | 3/1928 | United Kingdom | 416/189 |

*Primary Examiner*—Christopher Verdier
*Attorney, Agent, or Firm*—Morgan & Finnegan, L.L.P.

[57] ABSTRACT

A fan has a hub and a plurality of blades each having a medial line, a root region secured to the hub and extending radially outwardly to a tip region, with a leading edge and a trailing edge of each blade having a respective surface portion which is tangential to a respective radius of the fan, the leading edge and the trailing edge of each blade at the tip region being circumferentially behind, with respect to a first direction of rotation, the leading edge and trailing edge at the root region whereby the fan is rearwardly skewed wherein each blade has a dihedral angle formed between a plane perpendicular to a center axis of the fan and a line tangent to the medial line, each blade having a surface which is curved so that the dihedral angle decreases along the span of the blade moving from the root to the tip over a portion of the span equal to about 50% of the total span and wherein the dihedral angle increases over the remaining portion of the span.

14 Claims, 10 Drawing Sheets

AXIAL FLOW FAN BLADE STRUCTURE

FIELD OF THE INVENTION

The present invention relates to a fan, and particularly to an axial flow fan, for example a fan designed to cool air flowing through a heat exchange system in a vehicle. The invention is a C-I-P of application Ser. No. 08/314,827, filed on Sep. 29, 1994, now abandoned.

BACKGROUND OF THE INVENTION

Such axial flow fans are generally provided with a plurality of blades, each of which is secured at its root to a hub that is driven by a rotating shaft and from which the blade extends radially outwardly. The blades can be spaced around the hub in a symmetrical or non-symmetrical fashion. Axial flow fans are known having blades of various designs. Thus, the blades can be provided with a tangential sweep either in the forward or rearward direction, with variations in pitch angle to suit particular applications. Furthermore, it is known to secure the blade tips to an outer circular band which encloses the blades and is generally centered on the axis of rotation of the fan.

When used in a vehicular application, the fan can be arranged either to blow air through a heat exchange system if the heat exchange system is on the high-pressure (downstream) side of the fan or draw air through the heat exchange system if the heat exchange system is on the low-pressure (upstream) side of the fan. Such fans can be made from moulded plastics or from sheet metal or a combination of the two.

The performance of the fan is of particular concern when used to move air in an enclosed engine compartment. More particularly, there is a requirement for fans having high performance and efficiency and at the same time having reduced noise generation. Another requirement is that the fan should be strong enough to resist the stresses applied to it at high flow rates, and in adverse operating environments. Yet another requirement is to provide a compact fan capable of operation at high rotational speeds.

Reference is made to the following documents which describe fans designed particularly for vehicular cooling applications.

U.S. Pat. No. 4,358,245, U.S. Pat. No. 4,569,631 and U.S. Pat. No. 4,569,632 disclose fans of the general type with which the present invention is concerned and having blades which are skewed forwardly or rearwardly or a combination of forward and rearward skews to improve efficiency and reduce noise. GB-A-2178798 describes a fan having blades with a relatively more forwardly curved outer portion, said to reduce noise.

A first object of the present invention is to provide a fan having greater mechanical strength without loss of efficiency and flow performance characteristics as compared with the fans described in these prior art documents.

A second object of the invention is to provide a fan which is less noisy than equivalent fans of the prior art.

A third object of the invention is to provide minimum fan packaging while maintaining the fan system efficiency.

SUMMARY OF THE INVENTION

According to a first aspect of the invention there is provided a fan for rotation in a first direction about an axis at the centre of the fan, comprising a hub, and a plurality of blades each having a root region secured to the hub and extending radially outwardly to a tip region, a leading edge and a trailing edge of each blade having a respective surface portion which is tangential to a respective radius of the fan, the leading edge and the trailing edge of each blade at the tip region being circumferentially behind, with respect to the first direction, the leading edge and trailing edge at the root region whereby the fan is rearwardly skewed.

According to a second aspect of the invention there is provided a fan comprising a hub rotatable about an axis at the centre of the fan and a plurality of blades each having a root region secured to the hub and extending radially outwardly to a tip region and each having leading and trailing edges, wherein the leading and trailing edges each include a portion lying tangential to a respective radius extending from the centre of the fan, wherein a chord angle made between a chord of each blade and a plane perpendicular to the fan axis decreases with increase of blade radius, the chord being taken across an arc defined by a respective blade radius.

According to a third aspect of the invention there is provided a fan comprising a hub rotatable about an axis at the centre of the fan and a plurality of blades each having a root region secured to the hub and extending radially outwardly to a tip region, each blade having leading and trailing edges which each include a portion lying tangential to a respective radius extending from the centre of the fan, wherein the width of each blade projected onto a plane orthogonal to the axis decreases with increase of blade radius.

Conveniently each blade has a surface which is curved so that the dihedral angle varies along the span of the blade moving from the root to the tip, the dihedral angle being the angle defined between a plane tangential to the surface of the blade and the plane orthogonal to and containing the axis of rotation of the fan.

Advantagously the dihedral angle decreases moving from the root to the tip over a first portion of the span of the blade, said first portion being about 50% of the total span and then stays constant for the remainder of the span of the blade.

Alternatively the dihedral angle decreases moving from the root to the tip over a first portion of the span of the blade, said first portion being about 50% of the total span and then gradually increases for the remainder of the span of the blade.

Conveniently the tip regions of the blade are secured to an outer annular band having a bell mouth form.

The chord length may increase from the root region of the blade over about 50% of the span of the blade and then decrease over the remainder of the span of the blade.

Alternatively the chord length increases up to about 50% of the blade span, then decreases up to about 70% of the span before remaining substantially constant.

For a better understanding of the present invention and to show how the same may be carried into effect, reference will now be made by way of example to the accompanying drawings.

DESCRIPTION OF THE PREFERRED EMBODIMENT

Figure 1:
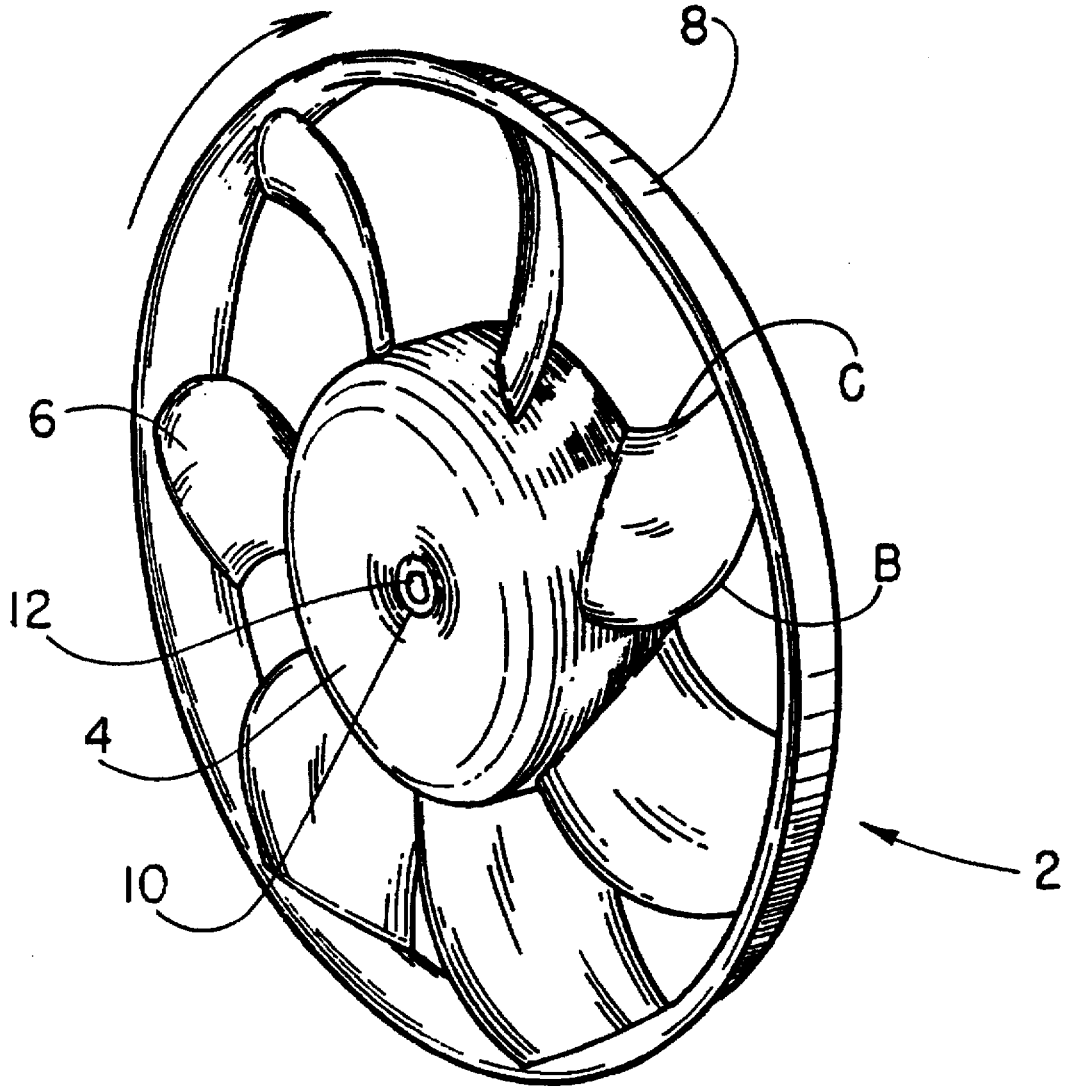
FIG. 1 is a perspective view of a fan from the front.
Figure 2:
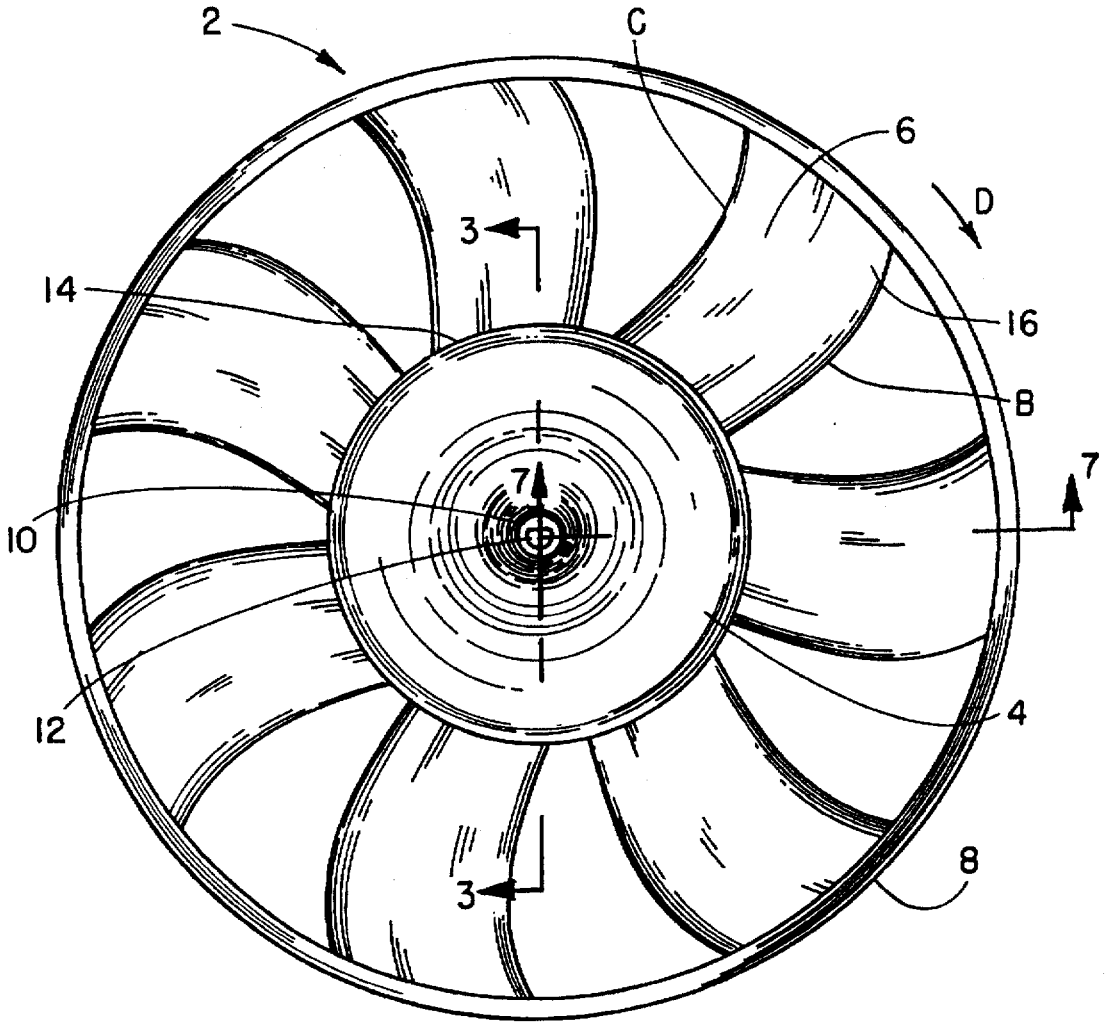
FIG. 2 is a plan view of the fan of FIG. 1, seen from the front.

FIGS. 1 and 2 show a fan 2 which has a centrally located cylindrical hub 4 with a plurality (seven as illustrated) of blades 6 extending radially outwardly therefrom to an outer band 8 having a generally cylindrical form.

The hub 4 carries a central hub insert 10 which defines an aperture 12 for accepting a shaft which mounts the fan for rotation around its central axis. The outer band 8 encloses the blades and is generally centered on the axis of rotation of the fan 2. Each blade 6 extends from a root region 14 secured to the hub 4 to an outer (or tip) region 16 secured to the inner surface of the band 8. The tip region 16 of the blades 6 are joined to the band over the full width of the blades and not at a single point or over a narrow connecting line. This increases the strength of the structure.

Figure 7:
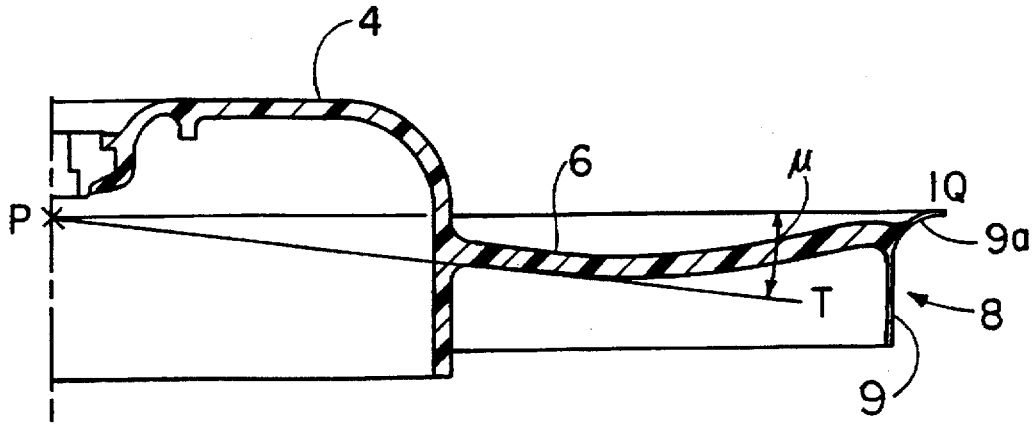
FIG. 7 is a cross-section through the fan taken along the line VII—VII in FIG. 2.

The outer band 8 of the fan adds structural strength to the fan by supporting the blades at their tip and also serves to hold air on the working surface of the blades. The band 8 is of uniform thickness and has a first axially extending cylindrical portion 9 and an axially extreme portion 9*a* which is curved radially outwardly to provide a bell-mouth, as is best seen in FIG. 7.

The curved portion 9*a* of the band 8 reduces losses due to vortices in a gap between the fan and a shroud member surrounding the fan. The band 8 furthermore provides a uniform flow passage of air flow passing through the fan and decreases unwanted variations in the dihedral angle $\mu$ and the pitch angle $\epsilon$ (see FIG. 6) of the blade by virtue of the tip support.

The blades 6 have respective leading edges B and trailing edges C and are shaped so that they are secured to the band 8 with the leading edge B tangential to the curved portion 9*a* of the band. This can be seen in FIG. 7.

Figure 10:
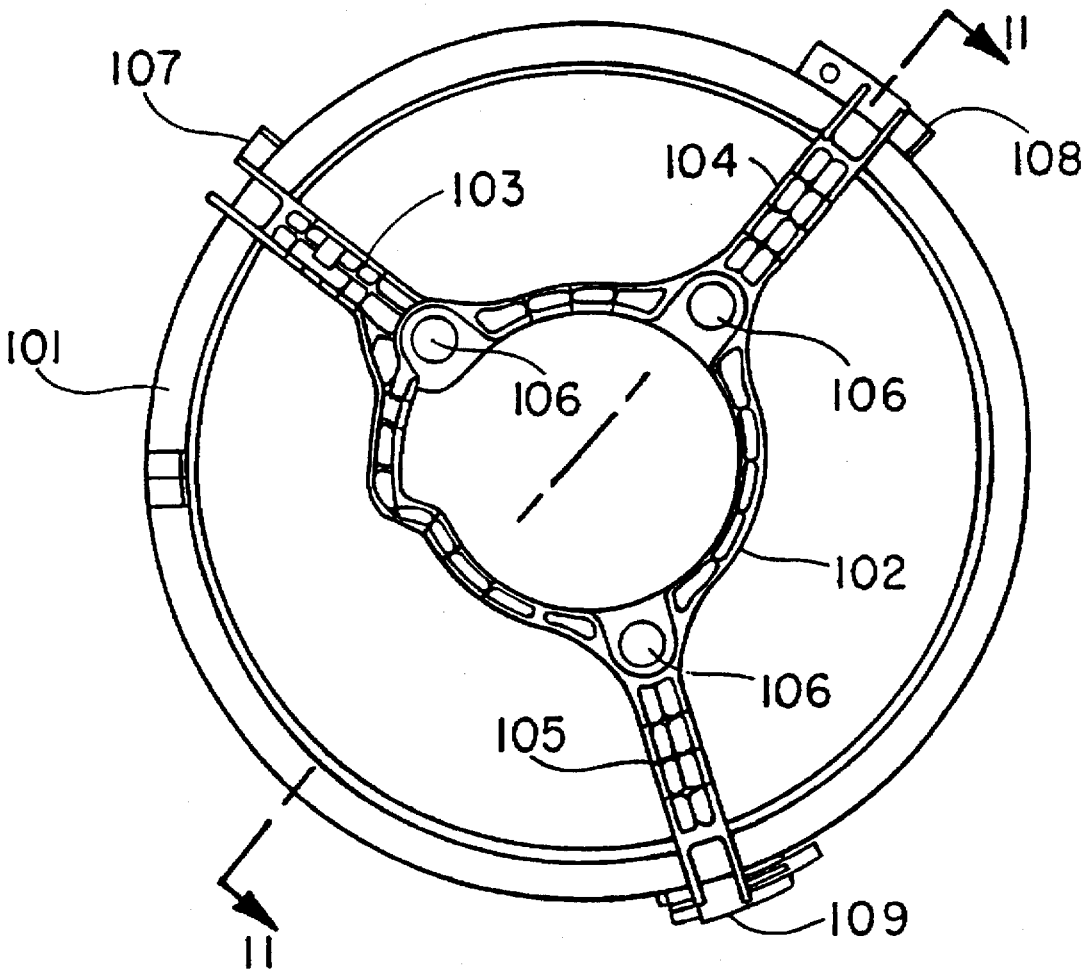
FIG. 10 shows a partial plan view of a fan mounting arrangement including a fan support.
Figure 11:
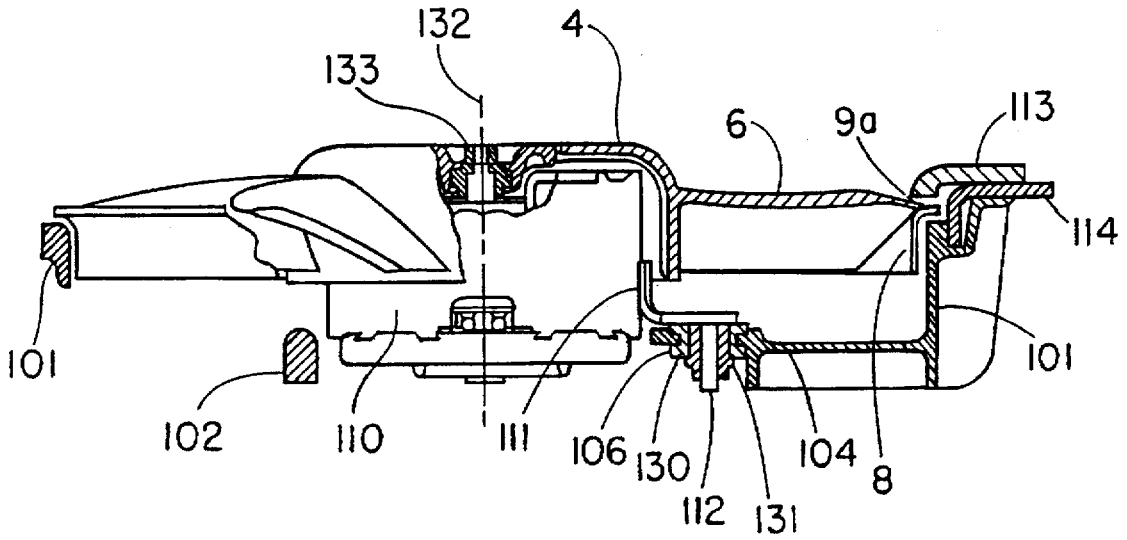
FIG. 11 shows a cross section through a fan, electric motor and ring support taken along line XI—XI in FIG. 10.
Figure 12:
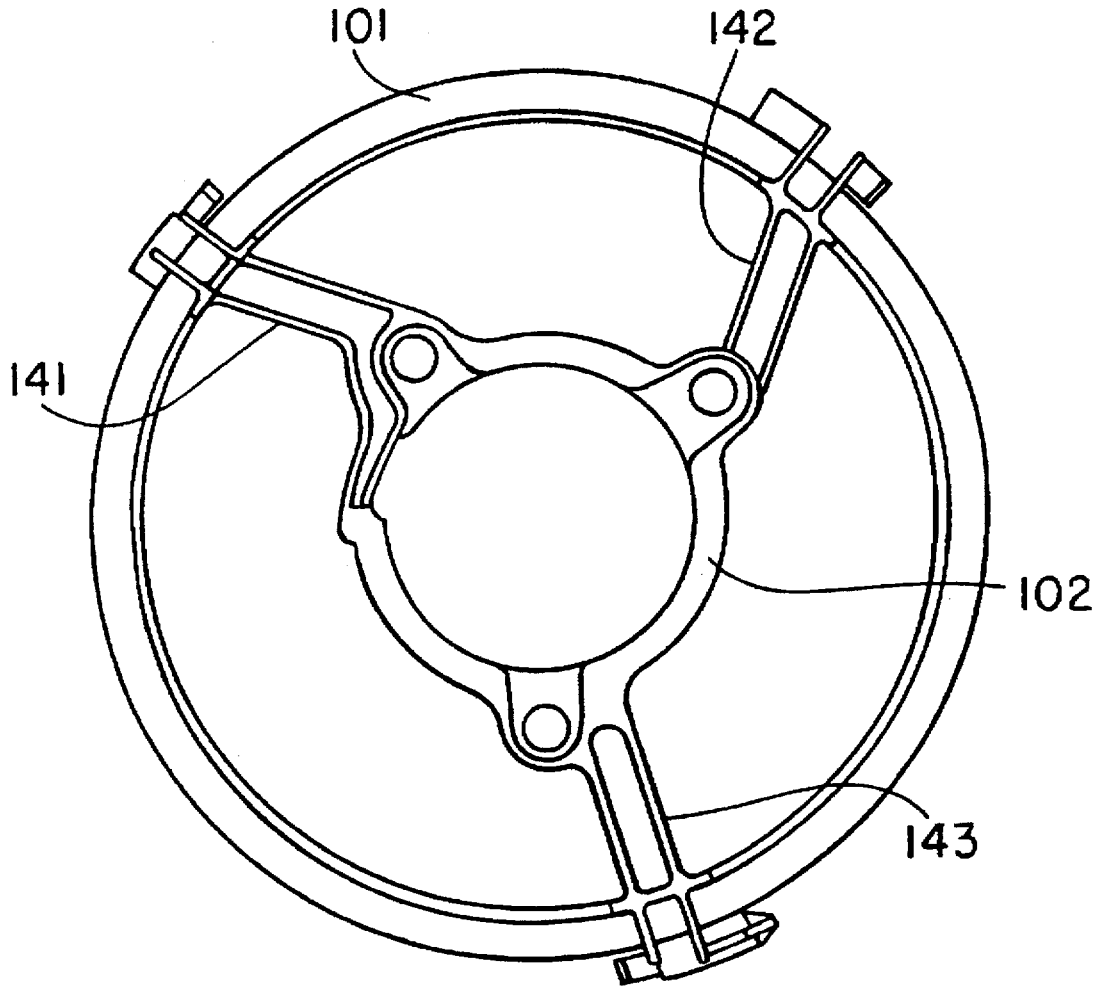
FIG. 12 shows a modification of the arrangement of FIG. 10.
Figure 15:
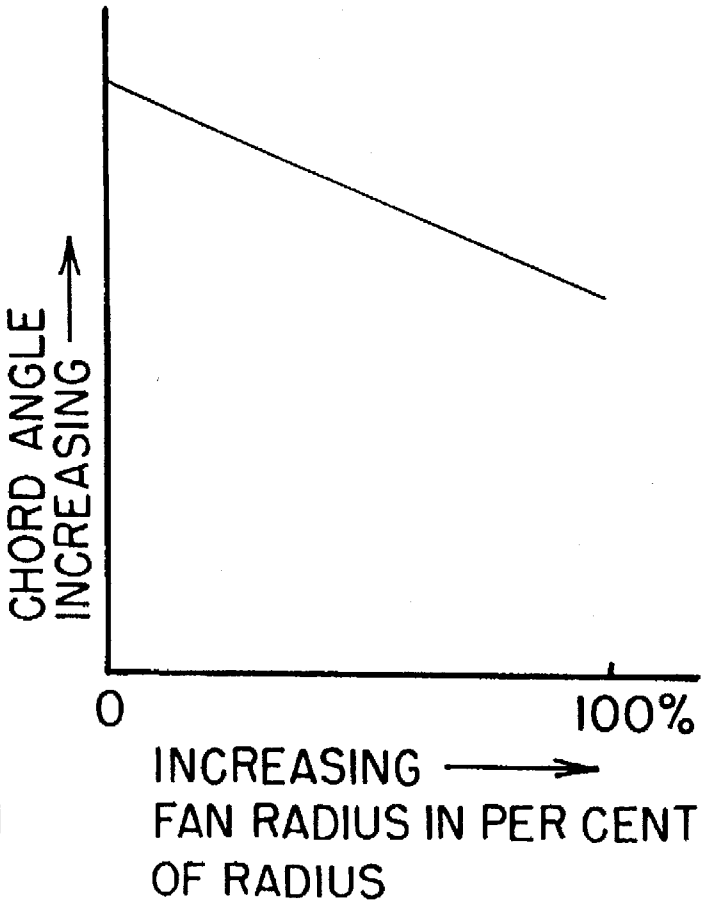
FIG. 15 is a schematic graph of the decrease in chord angle as a function of fan radius.
Figure 14:
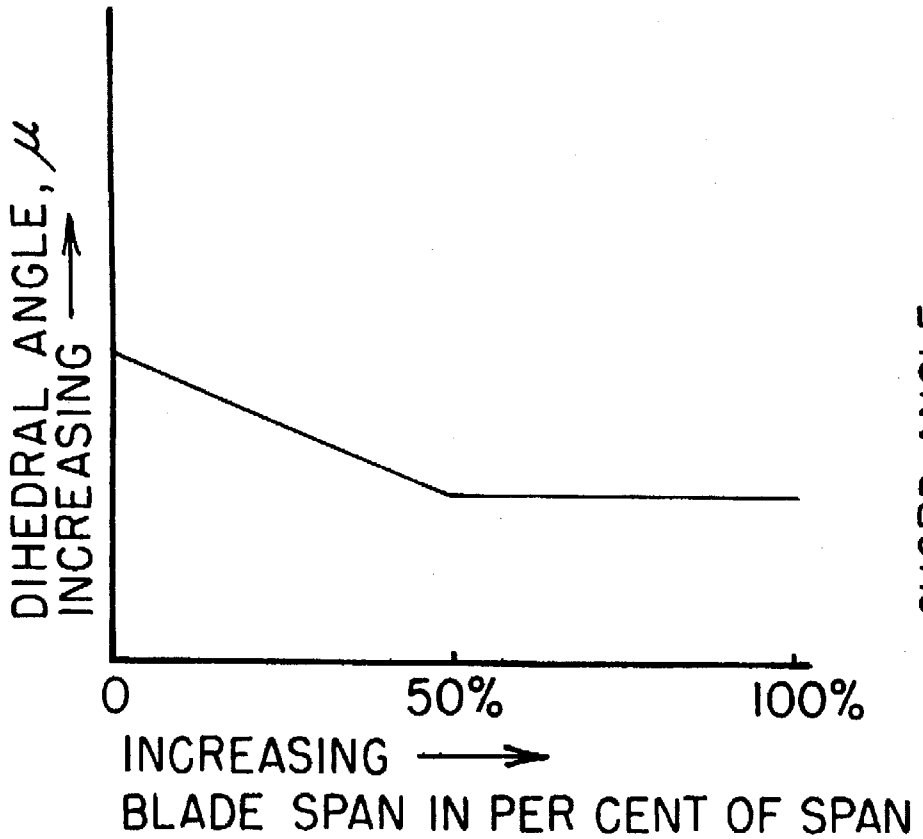
FIG. 14 is a schematic graph of dihedral angle as a function of blade span.

In use in a vehicular application for engine cooling, the fan can be positioned in front of or behind an engine cooling heat exchanger system comprising for example a radiator, condenser and oil cooler. The fan may be arranged so that air is either blown through the heat exchanger system if the heat exchanger is on the high pressure (downstream) side of the fan, or drawn through the heat exchanger system, if the exchanger is on the low pressure (upstream) side of the fan. The fan 2 is preferably used in conjunction with a shroud that extends between the radiator and the outer edge of the fan. The shroud serves to prevent recirculation of air around the outer edge of the fan from the high pressure region at the downstream side of the fan to the low pressure region at the opposite side of the fan adjacent the radiator. One known shroud structure is funnel-like as shown for example in U.S. Pat. No. 4,358,245. A second shroud arrangement is shown in FIGS. 10–12, and will be described later herein.

Reference will first be made to the design of the hub having regard to FIG. 3. The hub has a plastics moulded body member 18 which defines an outer cylindrical hub ring 20 and an inner cylindrical hub ring 22. The inner and outer hub rings define between them an annular space 21. The inner cylindrical hub ring 22 has first and second axially spaced annular ledges 24 and 25 which are directed radially inwardly. The ledges are provided for supporting a hub insert 10 as described in more detail hereinafter.

Figure 4:
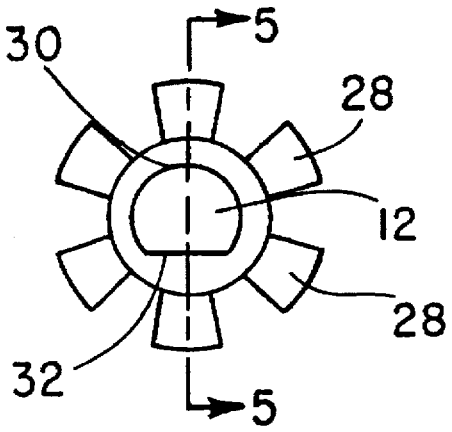
FIG. 4 is a plan view of a hub insert for the fan of FIGS. 1–3.
Figure 5:
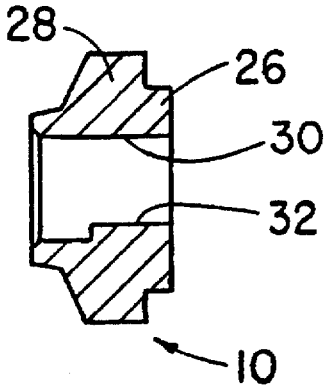
FIG. 5 is a cross-section of the hub insert of FIG. 4, taken along the line V—V in FIG. 4.

Referring to FIGS. 4 and 5, the hub insert 10 can be made of a plastics or metal material and is a body formed as a solid walled cylinder 26 having a plurality of peripheral circumferentially spaced protrusions 28 which form a castellated outer surface. The castellations may all be in the same plane perpendicular to the insert axis, or may be in different planes perpendicular to that axis. The insert 10 defines an aperture 12 having a first cylindrical portion and an adjoining portion in the form of a D shape, that is having an arcuate portion 30 and an opposing single flat portion 32. The flat portion 32 is for keying to a shaft inserted into the aperture 12 whereby rotation of the shaft with respect to the hub insert 10 is prevented. The castellated outer surface of the hub insert 10 enables the hub insert to be connected to the plastics moulded portion 18 of the hub in a single manufacturing step. That is, a mould defining the plastics moulded body portion 18 is provided in which the hub insert 10 is placed. Plastics material is injected into the mould in a known injection moulding process and enters between the protrusions 28 of the hub insert. Thus, a secure mechanical connection is provided between the hub insert 10 and the plastics moulded portion 18. The hub insert 10 provides a close fit and thus reduces the play between a shaft inserted into the aperture 12 and the insert 10. This thus helps preserve the fan balance when rotating and reduces drift of the fan from true axial rotation.

Use of a single flat portion 32 is advantageous in that the hub insert 10, and hence the fan, is always mounted in the same orientation with respect to the shaft. Hence balancing measures may be taken, without the possibility of the fan being refitted after removal in the opposite orientation, as would be possible if two flat portions were provided on both shaft and hub.

However, where such considerations are not significant, two or more flats could be provided, the same number being present in the shaft.

Referring again to FIG. 3, the annular space 21 between the inner and outer hub rings may accommodate the front face of an electrical motor 11D (FIG. 11) provided to drive the shaft. The motor is then protected by the moulded portion from the intrusion of moisture and dust.

The outer surface of the fan hub 4 approximates to a bowl shape which is more rounded than the straight cylindrical hubs of the prior art. More particularly, the hub outer surface has a central shallow depressed region 15 flanked by a substantially straight angled annular region 50. The annular region extends to a substantially planar annular region 52 which further extends into an outer cylindrical surface 55 of the hub via a radiussed portion 54. The elimination of a sharp angle at the front part of the hub reduces vortices forming at the hub surface. The formation of vortices, known as "vortex shedding" causes undesirable turbulence in the flow in the region of the hub, and gives rise to increased noise levels.

The minimum extent of the hub in the axial direction is at least equal to the axial blade extent at the root of the blade 6. The axial extent of the hub 4 and of the outer band 8 respectively may vary up to 50% of the axial extent of the band 8.

Figure 3:
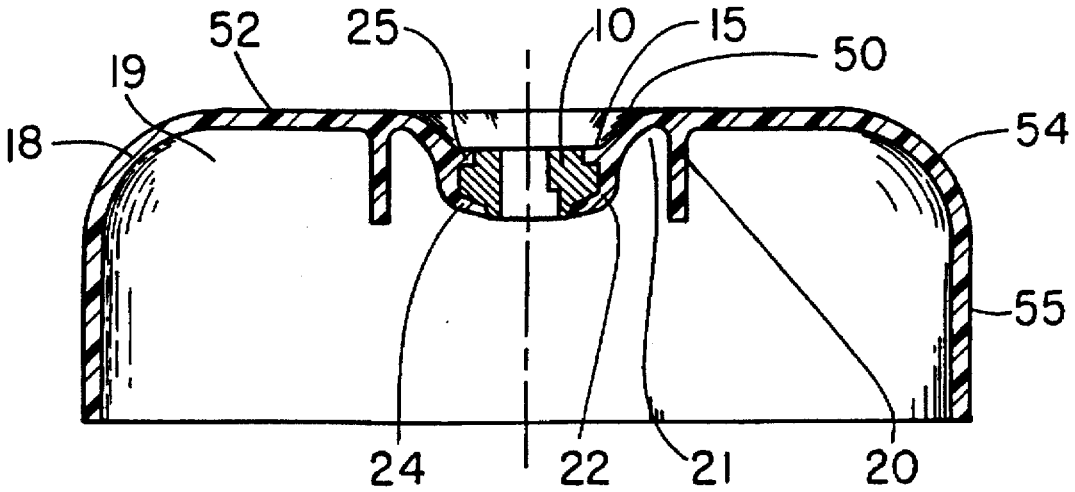
FIG. 3 is a cross-section taken through the hub of the fan along line III—III in FIG. 2.

The inner surface of the hub moulded portion 18 is provided with a plurality of radially extending ribs, one of which can be seen in FIG. 3 designated by reference numeral 19. The ribs 19 of which two are provided for each blade, are curved with the moulded plastics section 18 and serve to guide flow recirculating in the rear part of the hub in an effective manner to cool an electric motor by dissipating heat generated thereby. The ribs 19 extend radially inwardly towards the inner cylindrical ring 22 and thus also provide structural support for the hub body and hub insert.

Figure 6:
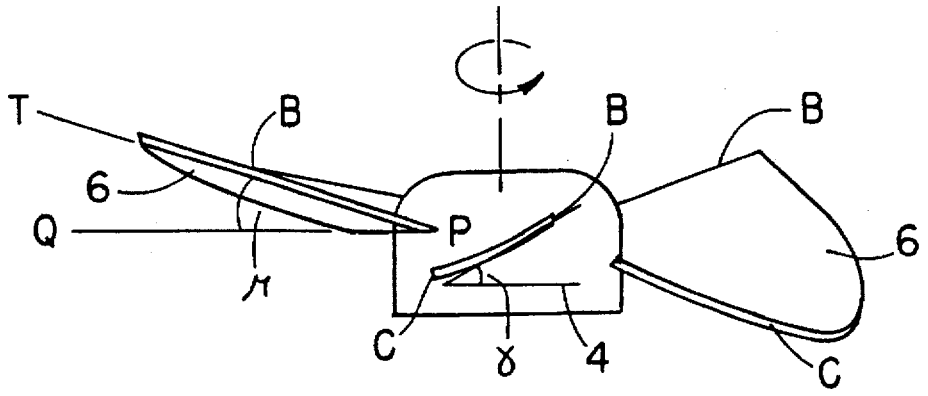
FIG. 6 illustrates diagrammatically the sweep, dihedral and pitch respectively of a fan blade.

Referring again to FIGS. 1 and 2, the blades of the fan will now be described. As shown in FIG. 1, each blade 6 is rearwardly skewed in that the medial line of the blade (which is the line obtained by joining the points that are circumferentially equidistant from the leading edge B and the trailing edge C of the blade) is curved in a direction (root to tip) opposite to the direction D of rotation of the fan 2. The leading and trailing edges B, C are curved in the same direction. The skew is referred to herein as the tangential sweep of the blade and is indicated diagrammatically by the angles $\lambda 1$, $\lambda 2$ and $\lambda 3$ in FIG. 8. Furthermore, each blade is secured to the hub so that the blade lies at a dihedral angle which is illustrated diagrammatically by angle $\mu$ in FIG. 6. The dihedral angle $\mu$ is the angle between a tangent plane P—T to the blade surface and a plane P—Q perpendicular to the axis of rotation. Furthermore, the blade is pitched so that the leading and trailing edges B and C are not in the same plane. The pitch angle $\epsilon$ alternatively known as the chord angle is also shown in FIG. 6.

FIG. 7 shows in section the blade 6 and the connection at the root to the hub 4 and at the tip to the band 8. FIG. 7 also shows a variation in the dihedral angle $\mu$ such that the dihedral angle decreases with respect to the radius of the fan along a medial line on the span of the blade over the first 50% of the innermost radius and then stays constant for the remaining 50%. As an alternative to the dihedral angle remaining constant over the remaining 50% of the blade span, it could increase slightly over this distance.

Figure 8:
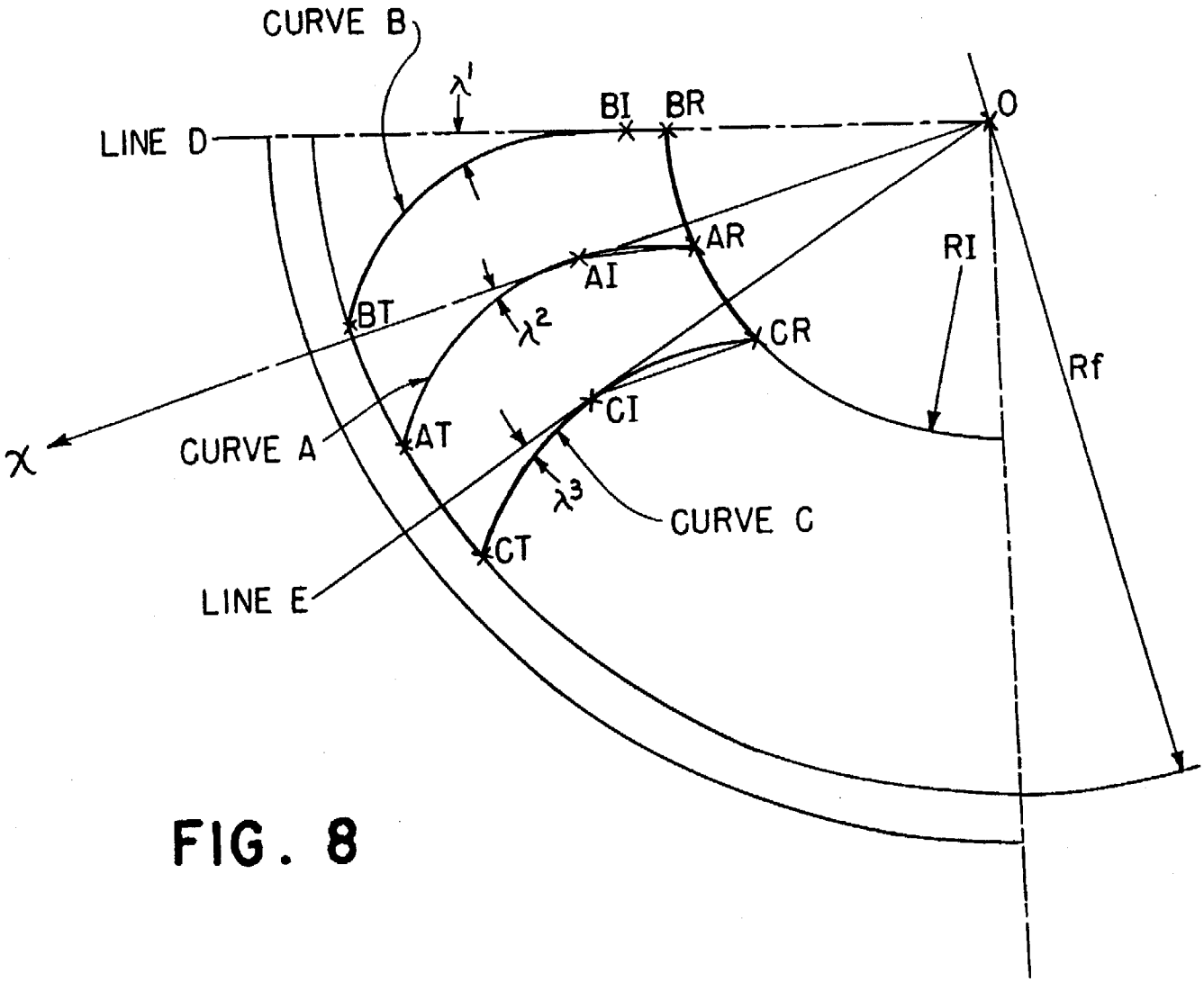
FIGS. 8 and 9 show the protection of a blade onto the plane orthogonal to the blade axis.

Reference will now be made to FIG. 8 to describe the tangential sweep of the blade 6. In FIG. 8, the fan origin is indicated as O. The leading edge B of the blade contains a portion BI at which the tangent D to the curve passes through the origin. Similarly, the medial line of the blade 6, shown as curve A, has a point AI, at which the tangent x to the line passes through the origin, and the curve C defining the trailing edge has a similar portion CI extending tangentially to the radial line E.

Figure 9:
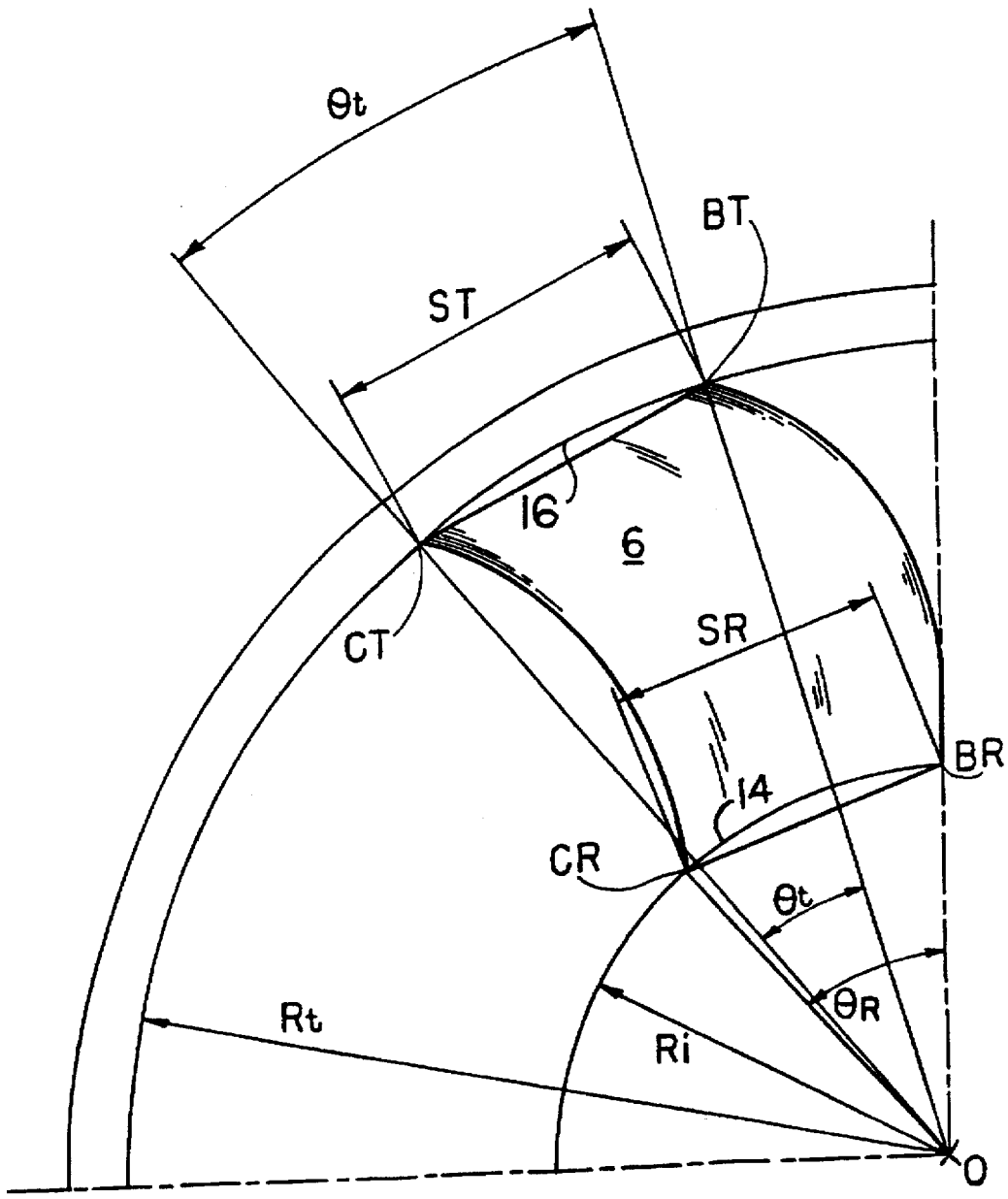

FIG. 9 illustrates the relationship between the projection of the chord length SR at the root 14 of the blade the chord length ST at the tip 16. Ri is the radius of the hub measured from the fan origin O and $\theta_R$ is the angle subtended by the root points CR, BR of the trailing and leading edges. The root chord projection length ST is given by $SR=Ri\theta_R$ where $\theta_R$ is in radians.

Points CT and BT are the trailing and leading edge tip points. Radii intersecting these tip points subtend an angle $\theta_r$. Hence the tip chord projection length is $ST=R_t\theta_t$ where $R_T$ is the outer fan radius. In the illustrated embodiment, $\theta_R$ is greater than $\theta_r$. Advantageously the chord length gradually increases from the root of the blade over the first about 50% of the span of the blade. The chord length may then decrease over the whole remaining span, or decrease up to about 70% of the span, after which it remains constant.

Referring again to FIG. 1, it will be seen that the blade is pitched so that the leading and trailing edges B and C are not in the same plane. The angle that the blade chord makes with the horizontal plane is termed the chord angle. The chord angle may decrease throughout the radius of the fan. Alternatively, the chord angle may decrease up to a selected fan radius. Outward from that selected radius, the angle may remain constant or increase, according to blade shape. In a preferred arrangement the selected fan radius is at about 75% of the blade span. The projected blade width gradually decreases from the root of the blade along the span of the blade, i.e. with increase of blade radius.

The preferred blade provides a downstream variable axial flow velocity which increases continuously from the hub to the outermost region of the blade, with the maximum axial velocities occurring over the outermost 25–35% of the blade. This enables the performance efficiency of the fan to be optimised whilst reducing the noise level.

Referring to FIGS. 10 and 11, a mounting arrangement for the fan of the invention will now be described:

Referring first to FIG. 10, the mounting arrangment generally consists of an outer annular ring 101 for coupling to the bodywork of a vehicle in which the fan is to be mounted, for example for coupling adjacent to a front face member, eg a so-called "plastic", of such a vehicle, and an inner generally annular ring 102 for supporting an electric motor (110—see FIG. 11) used to drive the fan. The inner ring is secured to the outer ring 101 by three arms 103, 104, 105, which as shown in FIG. 10 extend generally radially. At the junction of each arm with the inner ring 102 there is provided a respective hole 106. Each arm is prolonged beyond the outer periphery of the outer ring 102 to provide a respective bayonet fastening 107, 108, 109. The bayonet fastenings permit the fan, attached to the mounting arrangment to be axially offered to the counterpart opening of the vehicle bodywork and then circumferentially rotated into counterpart bayonet housings on the bodywork.

Referring now to FIG. 11, the fan 4 is shown secured to the electric drive motor 110, which in turn is mounted into the inner ring 102 of the mounting arrangement by a bracket 111.

The bracket 111 is secured to the mounting arrangement via a suitable screw 112 passing through a resilient mounting 130 described later herein, contained by hole 106. Wiring (not shown) for the motor is secured to and supported by one of the arms, so as not to impede the flow of air. The outer ring 101 extends beside the cylindrical portion 9 of the band 9 of the blades to define a narrow annular passageway therebetween which extends radially from the band 9. A front face portion of the ring 108 (see FIG. 10) is disposed immediately behind and adjacent the curved portion 9*a* of the tie band 8. The curved portion 9*a* of the band extends radially beyond the innermost radial extent of ring 101.

A member 113 consists of a generally annular ring secured to or integral with the vehicle body 114 and disposed forwardly of the fan. The ring member 113 has a lip which extends radially of the fan and back towards the curved portion 9*a* of the band 8. Member 113 and curved portion 9*a* define yet another narrow annular slot. The vehicle body 114 defines a circular passageway, and this surrounds the circumference of the bell mouth portion 9a to define a further annular passageway. The assembly of the ring 101, the body 114 and the member 113, together with the blade tie ring 8 provides a series of narrow passages between the front and rear of the fan and around the edge thereof. These passages form a labyrinth, and cooperate to impede blow-past of air. This improves efficiency and reduces noise.

Continuing to refer to FIG. 11, the bolt 112 securing bracket 111 with respect to the inner ring 102 is coupled to the ring 102 by a two-part resilient mounting, which consists of a first sleeve 130 having a circumferential slot extending transversally of the axis of the sleeve 130 so that the sleeve is retained grommet-fashion on ring 102. The sleeve has a radially-inner axial hole which receives and houses a second sleeve 131, which second sleeve has a radially-inner axial hole for the bolt 112.

As mentioned above, with reference to FIG. 10 the inner ring is supported with respect to the outer ring via three arms 103, 104 and 105. Three arms are used to prevent acoustic coincidence between the number of blades of the fan as well as providing the lowest impedance to air flow. Lack of acoustic coincidence prevents resonances from forming which would increase noise, lead to vibration or reduce the efficiency of the device. The arrangement is both lightweight and rigid.

Also shown in FIG. 11 is the manner of connection of the fan to the motor 110. As shown the motor has an axially projecting shaft 132 for mounting thereon of the fan. The shaft has a flattened axial portion for co-operation with the flat portion 32 of the hub insert and also has a circular protruding portion embraced by the circular aperture portion of the hub insert 10. An axially distal portion of the shaft is threaded to accept a nut 133.

To mount the fan upon the motor shaft 132, the motor and the fan are offered together and the fan is rotated until the flat 32 coincides with the flat portion of the motor shaft 132. The shaft may then be urged into the fan, whereby the threaded distal portion projects from the hub insert 10. The cylindrical part of the shaft is housed by the circular aperture portion of the hub insert 10, serving to centre the fan. The flat on the shaft cooperates with the flat on the insert 10 to rotatably couple the two together. The nut 133 is then applied to the end of the shaft and tightened. For compactness the axial extent of the nut is no greater than the axial extent of the central shallow depressed region 15 of the hub outer surface. When fully tightened the nut 133 engages with the axially outer surface of the hub insert 10, rather than engaging with the hub itself.

Where the fan is to be rotated clockwise, the thread on the motor shaft and the nut are each left handed; where the fan is for anticlockwise rotation, right handed threads are used.

Referring now to FIG. 12 a modification of the mounting arrangement of FIG. 10 is shown. Similarly to the arrangement shown in FIG. 10, the mounting arrangement has an outer ring 101 and an inner ring 102. However in this case the inner and outer rings are connected by arms 141, 142 and 143. To further reduce acoustic co-incidence, the arm 141 forms an acute angle with respect to a radius of the outer ring 101, the arm 142 forms a less acute angle with a radius of the outer ring 101 and the third arm 143 is parallel to such a radius. This arrangement is illustrative only and according to the acoustic requirements of the arrangement the arms can be radial, or may be deviated in the plane of rotation of the fan either forwardly or rearwardly with respect to the direction of rotation of the fan.

Figure 13:
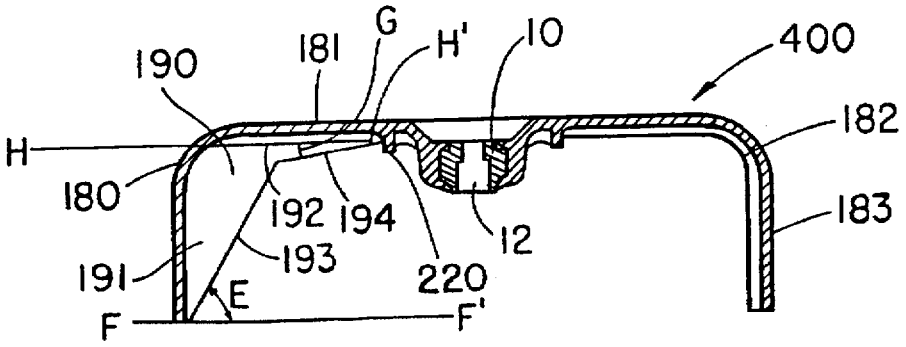
FIG. 13 shows a modification of the hub of FIG. 3 with an improved form of cooling vane.

Referring now to FIG. 13, a hub 400, similarly to hub 4 previously described with respect to FIG. 3, carries a central hub insert 10 which defines an aperture 12. The hub member 400 consists of a plastics moulded body member 180 which has a substantially planar front wall portion 181 of generally annular form. The front wall portion 181 extends via a radiussed portion 182 into a peripheral side wall portion 183 which is circular-cylindrical. Thus the hub body member 180 is generally bowl-shaped. The peripheral side wall portion 183 supports the root portion of the plural blades of the fan.

The inner surface of the hub member 180 is provided with plural radially-extending ribs, similarly to ribs 19 shown in FIG. 3. These ribs are not shown in FIG. 13, but are provided at the rate of one rib per blade, for example one corresponding to the leading edge of each blade. The inner surface of the hub member 180 is also provided with plural internal radially-extending vane members 190. The vane members 190 which are provided one per blade are of considerably greater area than the ribs 19, described herein with respect to FIG. 3. The vane members 190 have a first portion 191 which extends axially from the rearmost extremity of the peripheral sidewall portion along the peripheral wall portion to a second portion 192 which extends radially outwardly along the inside of the front wall portion 181.

The first portion 191 has a straight radially-inner edge 193 which makes an angle E to a plane F—F' which is perpendicular to the fan axis. The second portion also has a straight radially inner edge 194 which makes an angle G with another plane H—H' which is parallel to the plane F—F'. It has been found that increasing the surface area of the vane members 190 causes an increase of air flow within the hub, due to action as a turbine. In the described embodiment the angle E is 60 degrees and the angle G is 8 degrees.

As previously herein before described an electric motor used for driving the fan may be partly accommodated within the confines of the hub. Larger vane members increase the air flow through the motor, thus enhancing the cooling of the motor. However the particular shape of the vane members will be determined by the shape of the motor, since the hub must clear the motor to allow rotation.

Accordingly the vane members may have one or more straight edges, as shown in FIG. 13, or may be partly or wholly curved, either concave or convex according to the constraints of the motor, the desired cooling and the constraints imposed by the moulding technique. Equally the vane members may be aligned with fan radius, or may be skewed with respect thereto. If skewed, the vane members may be curved or straight.

Secondly the number of vane members can be increased so as to further enhance the air flow. However a problem may occur if a large number of large-area vane members are provided, since the weight of the fan overall is thereby increased. This adds to the inertia of the fan and thus requires a larger motor to drive the fan.

It will also be appreciated that the absolute number of vane members 190 and ribs 19 per fan may be varied, for example providing more than one vane member per fan blade, or only one vane member for every alternate blade.

I claim:

1. A fan having a center for rotation in a first direction about an axis at the fan center, comprising a hub, and a plurality of blades each having a medial line, a root region secured to the hub and extending radially outwardly to a tip region, a leading edge and a trailing edge of each blade having a respective surface portion which is tangential to a respective radius of the fan, the leading edge and the trailing edge of each blade at the tip region being circumferentially behind, with respect to the first direction of rotation, the leading edge and trailing edge at the root region whereby the fan is rearwardly skewed, wherein each blade has a dihedral angle formed between a plane perpendicular to the center axis of the fan and a line tangent to said medial line, each blade having a surface which is curved so that the dihedral angle decreases along the span of the blade moving from the root to the tip over a portion of the span equal to about 50% of the total span, and wherein the dihedral angle increases over the remaining portion of the span.

2. A fan in accordance with claim 1, wherein a chord angle made between a chord of each blade and a plane perpendicular to the fan axis decreases from the root region up to at least a selected blade radius, the chord being taken across an arc defined by a respective blade radius.

3. A fan in accordance with claim 1, wherein the tip regions of the blades are secured to an outer band having a bell mouth form.

4. A fan having a center for rotation in a first direction about an axis at the fan center, comprising a hub, and a plurality of blades each having a medial line, a root region secured to the hub and extending radially outwardly to a tip region, a leading edge and a trailing edge of each blade having a respective surface portion which is tangential to a respective radius of the fan, the leading edge and the trailing edge of each blade at the tip region being circumferentially behind, with respect to the first direction of rotation, the leading edge and trailing edge at the root region whereby the fan is rearwardly skewed, wherein each blade has a dihedral angle formed between a plane perpendicular to the center axis of the fan and a line tangent to said medial line, each blade having a surface which is curved so that the dihedral angle decreases along the span of the blade moving from the root to the tip over a portion of the span equal to about 50% of the total span and wherein the dihedral angle varies over substantially the whole span of the blade.

5. A fan having a center for rotation in a first direction about an axis at the fan center comprising a hub, and a plurality of blades each having a medial line, and a root region secured to the hub and extending radially outwardly to a tip region and each blade having leading and trailing edges, wherein the leading and trailing edges each include a portion lying tangential to a respective radius extending from the center of the fan, wherein a chord angle made between a chord of each blade and a plane perpendicular to the fan axis decreases with increase of blade radius, the chord being taken across an arc defined by a respective blade radius, said blade leading and trailing edges at the tip region thereof being behind, relative to the first direction of rotation, the leading and trailing edges of the respective blade at the root region, wherein each blade has a dihedral angle formed between a plane perpendicular to the center axis of the fan and a line tangent to said medial line, each blade having a surface which is curved so that the blade dihedral angle decreases along the span of the blade moving from the root to the tip over a portion of the span equal to about 50% of the total span, and wherein the dihedral angle increases over the remaining portion of the span.

6. A fan in accordance with claim 5 wherein the chord angle decreases only up to a selected blade radius.

7. A fan in accordance with claim 6 wherein said selected blade radius is about 75% of the blade span.

8. A fan in accordance with claim 6 wherein the chord angle remains constant outwardly of said selected blade radius.

9. A fan in accordance with claim 6 wherein the chord angle increases outwardly of said selected blade radius.

10. A fan in accordance with claim 5 further comprising a width for each blade.

11. A fan in accordance with claim 5 wherein the tip regions of the blades are secured to an outer band having a bell mouth form.

12. A fan comprising a hub rotatable in a first direction about an axis at the center of the fan and a plurality of blades each having a medial line, a root region secured to the hub and extending radially outwardly to a tip region, each blade having leading and trailing edges which each include a portion lying tangential to a respective radius extending from the center of the fan, said blade leading and trailing edges at the tip region thereof being behind, relative to the first direction of rotation, the leading and trailing edges of the respective blade at the root region, wherein each blade has a dihedral angle formed between a plane perpendicular to the center axis of the fan and a line tangent to said medial line, each blade dihedral angle decreases moving from the root to the tip over a first portion of the span of the blade, said first portion being about 50% of the total span, and then each blade dihedral angle increases for the remainder of the span of the blade.

13. A fan in accordance with claim 12 wherein the tip regions of the blades are secured to an outer band having a bell mouth form.

14. A fan according to any one of claims 1, 2, 4 through 11, 12 or 13, having a hub insert defining an aperture for a rotating shaft, and wherein the fan is integrally molded from plastics material about the hub insert.

* * * * *